United States Patent [19]

Sciabarassi

[11] Patent Number: 4,589,150

[45] Date of Patent: May 20, 1986

[54] REVERSIBLE DRAINBOARD FOR A CORNER SINK INSTALLATION

[76] Inventor: Augustine Sciabarassi, 8 Laural La., Levittown, N.Y. 11756

[21] Appl. No.: 734,551

[22] Filed: May 16, 1985

[51] Int. Cl.[4] ..... A47L 19/02

[52] U.S. Cl. ..... 4/656; 108/24; 211/41; D32/56; D7/46

[58] Field of Search ..... 4/656, 637; 68/233; 108/12, 24; 211/41; D23/60, 63; D32/56; D7/46; 34/238

[56] References Cited

U.S. PATENT DOCUMENTS

| | | | |
|---|---|---|---|
| D. 31,491 | 9/1899 | Haynes | D32/56 |
| D. 33,418 | 10/1900 | Thompson | D7/46 |
| D. 33,465 | 10/1900 | Gavin . | |
| D. 143,516 | 1/1946 | Whitlock . | |
| D. 143,517 | 1/1946 | Whitlock . | |
| D. 151,047 | 9/1948 | Jensen . | |
| D. 205,833 | 9/1966 | Gardner . | |
| D. 274,568 | 7/1984 | Carrothers | D32/56 |
| 508,885 | 11/1893 | Johnston | 211/41 |
| 678,008 | 7/1901 | McKinney . | |
| 933,180 | 9/1909 | Johnson . | |
| 1,224,838 | 5/1917 | Blissman et al. . | |
| 1,521,752 | 1/1925 | Chapman | 34/238 |
| 2,026,952 | 1/1936 | Reed et al. | 4/637 |
| 2,028,803 | 1/1936 | Ottke | 4/637 |
| 4,480,343 | 11/1984 | Drach | 4/656 |

FOREIGN PATENT DOCUMENTS

| | | | |
|---|---|---|---|
| 12097 | of 1903 | United Kingdom | 211/41 |

*Primary Examiner*—Charles E. Phillips
*Attorney, Agent, or Firm*—David M. Rosenblum

[57] ABSTRACT

The present invention provides a reversible drainboard that can be used on either side of a corner sink installation. In such an installation, the sink is installed in the corner formed by a pair of orthogonally connected kitchen counters at a 45 degree angle to the lengthwise sides of the counters. The drainboard has a planar member bounded by a lengthwise, tapered sidewall having a maximum height greater than the thickness of the planar member. The planar member has an oblique front edge that forms an angle of 135 degrees with a datum line parallel to the length thereof. The drainboard is operable to be reversed between positions on either side of the sink with the oblique front edge thereof in an overlying and parallel relationship with either of the sides of the sink.

6 Claims, 4 Drawing Figures

REVERSIBLE DRAINBOARD FOR A CORNER SINK INSTALLATION

FIELD OF THE INVENTION

This invention relates to drainboards for kitchen counters and more particularly to a drainboard that can be utilized on either side of the sink installed in the corner of a kitchen.

BACKGROUND OF THE INVENTION

Drainboards, as well known in the art, are normally placed on a kitchen counter to one side of a kitchen sink. Dishracks and the like are then placed on the drainboard to allow the dishes to dry after washing. Examples of such drainboards can be found in U.S. Pat. No. 678,008, entitled "Drain Board," which issued to W. C. McKinney on July 9, 1901, U.S. Pat. No. 933,180, entitled, "Drain Board," which issued to W. S. Johnson on Sept. 7, 1909, U.S. Pat. No. 1,224,838, entitled, "Portable Drain Board," which issued to A. Blissman Et al. on May 1, 1917, U.S. Pat. No. D. 143,516, entitled, "Drainboard for a Sink," which issued to G. E. Whitlock on Jan. 8, 1946, U.S. Pat. No. D. 151,047, entitled, "Combined Portable Drainboard, serving Tray, and Cooling Rack," which issued to D. G. Jensen on Sept. 21, 1948, U.S. Pat. No. D. 205,833, entitled, "Drainage Tray for Sink or The Like," which issued to Gardner on Sept. 27, 1966. Such drainboards have planar surfaces of rectangular configuration that slope downwardly toward the sink to facilitate drainage. Gutters or channels are also provided in such planar surfaces for drainage purposes.

None of the drainboards of the prior art can be utilized with a sink installed in the corner of a kitchen. In such a corner sink installation, generally a pair of rectangular kitchen counters are orthagonally connected to one another in a corner of the kitchen. The sink is mounted in the corner formed by the counters at a 45 degree angle to the sides of the counters. As is readily apparent, a conventional rectangular drainboard cannot be used in this installation because it will not fit between the sides of the sink and the kitchen wall. In fact, the market place solution for this design problem has been to provide a scaled down version of a conventional rectangular drainboard.

The present invention seeks to remedy this design problem by providing a drainboard having an angled, oblique front edge that permits the the utilization of a full size drainboard. Moreover, in another one of its aspects, the present invention provides a drainboard that is reversible to permit the drainboard hereof to be utilized on either side of the sink.

SUMMARY OF THE INVENTION

In accordance with the present invention, a reversible drainboard for a corner sink installation is provided. The corner sink installation has a pair of rectangular kitchen counters orthagonally connected to one another in the corner of a kitchen. A sink is mounted in the counters at the connection thereof at an angle of 45 degrees with respect to the lengthwise sides of said counters. The drainboard comprises a planar member and a sidewall.

The planar member has a plurality of outer peripheral edges connected end to end to form the outer periphery of the planar member and the length and the width thereof. The outer peripheral edges include an oblique front edge having the length of at least a side of the sink and an angular orientation of 135 degrees with respect to a datum line parallel to the length of the planar member. The planar member also has a pair of opposed first and second surfaces defined between the oblique front edge and the remaining of the peripheral edges. The first and second surfaces are spaced from one another to form the thickness of the planar member.

The sidewall has a height greater than the thickness of the planar member. The sidewall is connected to the remaining of the peripheral edges along the length thereof, from one end of the oblique front edge to the other end thereof, with the planar member located between the height of the sidewall.

The drainboard is operable to be positioned on one of the counters with the oblique front edge in an overlying and parallel relationship with one of the sides of the sink and with the second surface facing the counter. Alternately, the drainboard is operable to be reversed and positioned on the other of the counters with the oblique front edge in an overlying and parallel relationship with the other side of the sink and with the first surface facing the counter.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

DESCRIPTION OF THE PREFERRED EMBODIMENT

Figure 1:
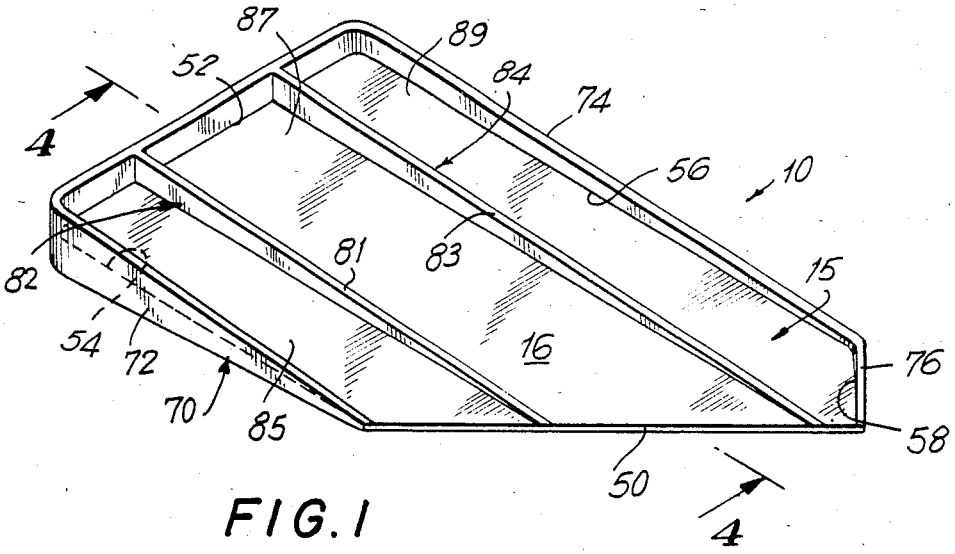
FIG. 1 is a front perspective view of the drainboard of the present invention.

Referring now to FIG. 1, drainboard 10 of the present invetion can generally comprise a planar member 15 having oblique front edge 50 and a sidewall 70. As can best be seen in FIG. 2, the corner sink installation can include a pair of rectangular kitchen counters 20 and 30 orthangonally connected to one another in the corner of a kitchen having walls 26 and 36. A sink 40 is mounted in counters 20 and 30 at the connection thereof at an angle of 45 degrees with respect to the lengthwise sides 22 and 24; and 32 and 34 of the counters 20 and 30.

Figure 2:
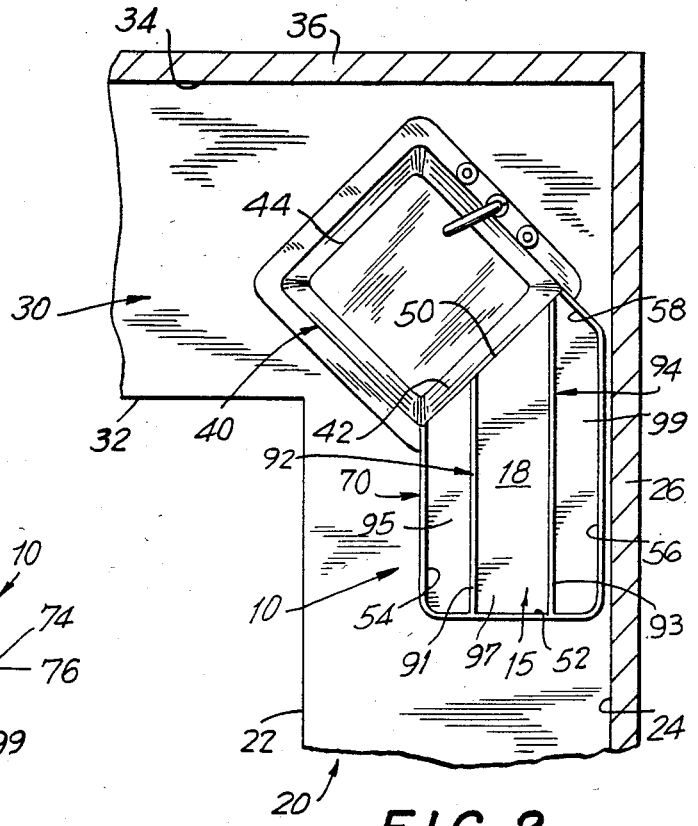
FIG. 2 is a top plan view of the drainboard of the present invention, reversed in position from that of FIG. 1, illustrated in use in a corner sink installation.

The drainboard 10 of the present invention is operable to be positioned on counter 30 to one side of the sink 40, with oblique front edge 50 in an overlying and parallel relationship with the side 42 of the sink 40. This position is illustrated in FIG. 2. In such position, the first surface 16 faces counter 20. The drainboard 10 of the present invention is also operable to be positioned on counter 30 by reversing it so that it would be in the orientation illustrated in FIG. 1. Although not illustrated, drainboard 10 could then be placed on counter 30 with the oblique front edge 50 in an overlying and parallel relationship with the other side, 44 of the sink 40 and with the second surface 18 facing counter 30.

Having thus generally described the preferred embodiment, a more detailed description follows with a description of planar member 15. Planar member 15 is sized to fit within a quadralateral area bounded by either one of the counters 20 and 30 and the sink 40. The planar member 15 has a plurality of outer peripheral edges 50, 52, 54, 56 and 58, connected end to end to form the outer periphery and the length and the width of the planar member 15. One of the peripheral edges, 50, comprises the aforementioned oblique front edge. Oblique front edge 50 has the length of at least the side of the sink 40 (either side 42 or 44,) and an angular orientation of 135 degrees with respect to a datum line parallel to the length of the planar member 15. Such a datum line in the illustrated embodiment can be seen to be coincident with the edge 54 of the planar member 15. As can be appreciated, the angular orientation of the oblique front edge 50 permits the drainboard 10 to be utilized within the confines of either of the kitchen counters 20 and 30 and the sink 40. Thus, the drainboard 10 can be made full size so that a conventional, full size dishrack can be used therewith.

The remaining of the peripheral edges include edges 52 through 58 inclusive. Back edge 52 is spaced from oblique front edge 50. Back edge 52 has an angular orientation such that oblique front edge 50 form an angle of 45 degrees thereto and a transverse extent greater than that of oblique front edge 50. Left side edge 54 connects one end of the back edge 52 to one end of the oblique front edge 50. First, right side edge 56 is provided parallel to the left side edge 54 and is connected to the other end of the back edge 52. The figure is closed by second right side edge 58 connecting the other end of the first right side edge 56 and the other end of the oblique front edge 50. As illustrated in Figure 2, the drainboard is sized very much smaller than the available area on the counter 30 but as could be appreciated, it could have any size within the limits discussed above. Moreover, although the preferred drainboard 10 has an advantageous configuration in that it completely fills the space to the side of the sink 40, it can also be appreciated that other shapes could be used in accordance with any design requirement.

Figure 4:
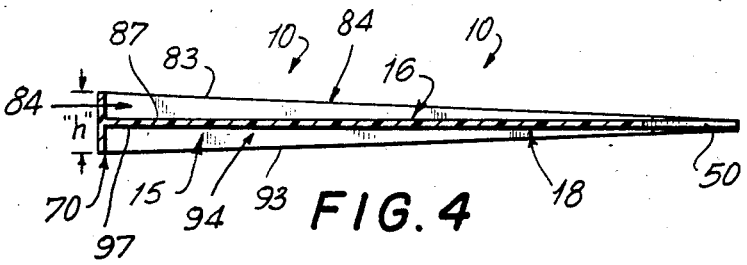
FIG. 4 is a cross sectional view of the drainboard of the present invention taken along line 4—4 of FIG. 1.

Referring now to FIGS. 1 and 4, the drainboard 10 is also provided with a sidewall 70 having a maximum height "h" defined by an upper and a lower surface. This height is greater than the thickness of the planar member 15. Sidewall 70 is connected to the peripheral edges 52, 54, 56 and 58 from one end of oblique front edge 50 to the other end of oblique front edge 50 with the planar member thus defined located between the height "h" of sidewall 70. The portions of the sidewall 72, 74 and 76, connected to the edges 54, 56 and 58, that run along the length of the planar member 15, can be tapered towards the oblique front edge 50. The purpose of this taper is to allow water to drain along the first and second surfaces 16 and 18 and from oblique front edge 50 when the drainboard 10 is on either of the counters 20 and 30 and in either one of its positions with respect to the sink 40. The sidewall 70 could of course have a constant height greater than the thickness of the planar member 15. The disadvantage of such a possible embodiment would be that water on the drainboard 10 would pool and thus could only dry by the process of evaporation.

In addition to its drainage function, the sidewall 70 also serves two other major functions. Since sidewall 70 has a height greater than the thickness of the planar member 15, one function of the sidewall 70 is to contain water that drips off drying dishes and the like. Also, since sidewall 70 supports supports the planar member 15 out of contact with the surface of the kitchen counter, water and kitchen spills are prevented from accumulating beneath the drainboard 10.

The planar member 15 is further provided with the aforementioned first surface 16 and second surface 18. Surfaces 16 and 18 are defined between the oblique front edge 50 and the remaining of the outer peripheral edges 52 through 58. Surfaces 16 and 18 are also spaced from one another to form the thickness of the planar member 15. Referring now to FIG. 4, it can be seen that in the preferred embodiment, the thickness of planar member 15 is constant. However, it is appropriate to mention that if sidewall 70 were provided with a constant height, surfaces 16 and 18 of a possible planar member 15 could slope towards one another and the oblique front edge 50 to allow water to drain along the first and second surfaces 16 and 18. As can be appreciated, in such a possible embodiment, the planar member thereof would have to be made thicker than the planar member 15 of the preferred embodiment in order to incorporate a pair of sloping, opposed surfaces. Such an embodiment is not preferred in that more material would be required in the fabrication of such a thicker planar member.

Figure 3:
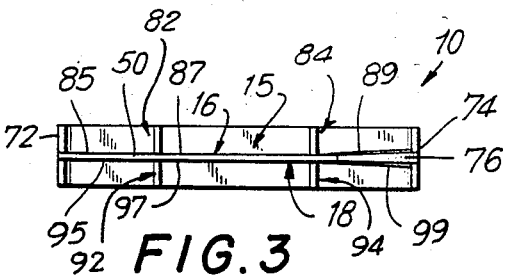
FIG. 3 is a front elevational view of FIG. 1.

As can best be seen in FIG. 3, the first and second surfaces 16 and 18 respectively have a first set of drainage channels 85, 87 and 89 running along the length of planar member 15 from back edge 52 towards oblique front edge 50 in first surface 16; and a second set of drainage channels 95, 97 and 99 also running along the length of planar member 15 from back edge 52 towards oblique front edge 50 in second surface 18. In each set of drainage channels, the drainage channels are equally spaced from one another and between the portions of the sidewall 70 connected to left side edge 54 and first right side edge 56. As illustrated, the drainage channels are parallel to one another. The purpose of such channels is to localize drips from drying dishes and the like and to drain the same into the sink 40. There can be more or less channels provided in the first and second surfaces 16 and 18 of the planar member 15. In fact the sets of channels could be deleted from a possible embodiment of the present invention with a concommitant loss of the advangageous drainage as previously described.

The aforementioned first set of channels 85, 87 and 89 can be formed by provision of a first set of ribs 82 and 84 equally spaced apart from one another and between the portions of the sidewall 70 connected to the left side edge 54 and the first right side edge 56. The first set of ribs extend from surface 16 of planar member 15 and run from the back edge 52 to the front oblique edge 50 thereof. The ribs 82 and 84 are tapered such that the upper surfaces 81 and 83 thereof are parallel to the tapered portions 72, 74 and 76 of sidewall 70 adjacent thereto. As can best be seen in FIG. 1, the first set of ribs together with the sidewall 70 form the lengthwise sides of channels 85, 87 and 89. The first surface 16 forms the floor of channels 85, 87 and 89. In a like manner, there can additionally be provided a second set of ribs which can be, as in the illustrated preferred embodiment, a pair of ribs 92 and 94. The ribs 92 and 94 are tapered such that the upper surfaces 91 and 93 thereof are parallel to the tapered portions 72, 74 and 76 of sidewall 70. Additionally, the ribs 92 and 94 in the same manner as the ribs 82 and 84 and the sidewall 70 form the lengthwise sides of the second set of channels 95, 97 and 99. The second surface 18 forms the floor of channels 95, 97 and 99. There can of course be more or less ribs in accordance with the number of channels. Moreover, the ribs could be deleted in a possible embodiment of the present invention. A major disadvantage of this would be that the planar member 15 would have no central structural support for a dishrack and the like. Moreover, if channels in such an embodiment were still desired, the drainboard 10 of the present invention would have to be made much thicker to accomodate such channels.

Drainboard 10 can be advantageously fabricated using plastic and rubber forming techniques that are well known in the art.

It will be understood by those skilled in the art that the invention has been described with reference to an exempliary preferred embodiment and that variations and modifications, in addition to those previously described, can be effected in the described embodiment without departing from the spirit and scope of the invention.

What is claimed is:

1. A reversible drainboard for a corner sink installation having a pair of rectangular kitchen counters orthagonally connected to one another in the corner of a kitchen and a sink mounted in said counters at the connection thereof at an angle of 45 degrees with respect to the lengthwise sides of said counters, said drainboard comprising:

a planar member having:

a plurality of outer peripheral edges connected end to end to form the outer periphery of said planar member and the length and the width thereof, said outer peripheral edges including an oblique front edge having the length of at least a side of said sink and an angular orientation of 135 degrees with respect to a datum line parallel to said length of said planar member; and a pair of opposed first and second surfaces defined between the said oblique front edge and the remaining of said peripheral edges, said surfaces being spaced from one another to form the thickness of said planar member; and a sidewall having a height defined by an upper and a lower surface, said height being greater than the thickness of said planar member, said sidewall connected only to said remaining of the said peripheral edges along the length thereof, from one end of said oblique front edge to the other end thereof, with said planar member located above said lower surface and below said upper surface of said sidewall, whereby said drainboard is operable to be positioned on one of said counters with said oblique front edge in an overlying and parallel relationship with one of the sides of said sink and the said second surface facing the said counter or alternately reversed and positioned on the other of said counters with said oblique front edge in an overlying and parallel relationship with the other of the sides of said sink and with said said first surface facing the said counter; said side wall that are connected to said peripheral edges running along said length of said planar member are tapered towards the said oblique front edge thereof to allow water to drain along said first and second surfaces and from said oblique front edge when said drainboard is in either of its said positions with respect to said sink.

2. The drainboard of claim 1 wherein said remaining outer peripheral edges comprise a back edge spaced from said oblique front edge having a transvese extent greater than that of said oblique front edge and an angular orientation such that said oblique front edge forms an angle of 45 degrees thereto, a left side edge connecting one end of said back edge to said one end of said oblique front edge, a first, right side edge, parallel to said left side edge, connected at one end to the other end of said back edge and a second right side edge, connecting the other end of said first right side edge to the said other end of said oblique front edge and wherein said sidewall is connected to said left side edge, said back edge, said first right side edge and said second right side edge and the portions of said sidewall that are tapered are those connected to said first and second right side edges and said left side edge.

3. The drainboard of claim 2 wherein said first surface has a first set of drainage channels running from said back edge towards said oblique front edge and wherein said second surface has a second set of drainage channels running from said back edge towards said oblique front edge.

4. The drainboard of claim 3 wherein the lengthwise sides of said drainage channels of said first and second set are parallel to one another, equally spaced from one another and equally spaced between the portions of said sidewall connected to said left side edge and said first right edge.

5. The drainboard of claim 4 wherein said first surface further has a first set of ribs extending therefrom and running from said back edge to said oblique front edge, said first set of ribs being tapered such that the upper surfaces thereof are parallel to the tapered portions of said sidewall adjacent thereto, said first set of ribs being equally spaced apart from one another and between said portions of said sidewall connected to said left side edge and said first right side edge, and said first set of ribs forming the lengthwise sides of said first set of channels and said first surface forming the floor of said first set of channels and wherein said second surface further has a second set of ribs extending therefrom and running from said back edge to said oblique front edge, said second set of ribs being tapered such that the upper surfaces thereof are parallel to the tapered portions of said sidewall adjacent thereto, said second set of ribs being equally spaced apart from one another and between said portions of said sidewall connected to said left side edge and said first right side edge, and said second set of ribs forming the lengthwise sides of said second set of channels and said second surface forming the floor of said second set of channels.

6. The drainboard of claim 5 wherein said first set of ribs comprises a pair of ribs and said first set of channels comprises a set of three channels and wherein said second set of ribs comprises a pair of ribs and said second set of channels comprises a set of three channels.

* * * * *